US011433672B2

(12) United States Patent
Kanzaki et al.

(10) Patent No.: US 11,433,672 B2
(45) Date of Patent: Sep. 6, 2022

(54) LIQUID DISCHARGE HEAD

(71) Applicant: Brother Kogyo Kabushiki Kaisha, Nagoya (JP)

(72) Inventors: Shotaro Kanzaki, Handa (JP); Jiro Yamamoto, Nagoya (JP); Taisuke Mizuno, Yokkaichi (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 66 days.

(21) Appl. No.: 17/173,972

(22) Filed: Feb. 11, 2021

(65) Prior Publication Data

US 2021/0245507 A1 Aug. 12, 2021

(30) Foreign Application Priority Data

Feb. 12, 2020 (JP) ..... JP2020-021607

(51) Int. Cl.
*B41J 2/14* (2006.01)

(52) U.S. Cl.
CPC .... *B41J 2/1433* (2013.01); *B41J 2002/14467* (2013.01)

(58) Field of Classification Search
CPC ..... B41J 2/1433; B41J 2002/14459
See application file for complete search history.

(56) References Cited

U.S. PATENT DOCUMENTS

2011/0027132 A1 2/2011 Nukumi et al.
2015/0360467 A1* 12/2015 Gejima ..... B41J 2/055 347/44

FOREIGN PATENT DOCUMENTS

EP 3199354 A1 * 8/2017 ..... B41J 2/14
JP 2008-290292 A 12/2008
JP 2009-227704 A 10/2009

* cited by examiner

*Primary Examiner* — Jason S Uhlenhake
(74) *Attorney, Agent, or Firm* — Banner & Witcoff, Ltd.

(57) ABSTRACT

A liquid discharge head, includes an individual channel, and first and second common channels. The individual channel includes: a nozzle; a pressure chamber; a connection channel; a first communication channel; and a second communication channel. A first vector is defined such that a starting point and ending point are located on the connection channel, and a second vector is defined such that a starting point and an ending point are located on the second communication channel. A first angle formed by a projection vector of the first vector onto the first plane and a projection vector of the second vector onto the first plane is less than 90°. A second angle formed by a projection vector of the first vector onto the second plane and the second vector is less than 90°.

14 Claims, 8 Drawing Sheets

LIQUID DISCHARGE HEAD

CROSS REFERENCE TO RELATED APPLICATION

The present application claims priority from Japanese Patent Application No. 2020-021607 filed on Feb. 12, 2020, the disclosure of which is incorporated herein by reference in its entirety.

BACKGROUND OF THE INVENTION

Field of the Invention

The present disclosure relates to a liquid discharge head including individual channels, a first common channel, and a second common channel.

Description of the Related Art

Japanese Patent Application Laid-open No. 2008-290292 (FIGS. 5 to 7) discloses an ink-jet recording head (liquid discharge head) including ejectors (individual channels) arranged in a Y direction, a common supply branch passage (first common channel) extending in the Y direction and communicating with the ejectors, and a common discharge branch passage (second common channel) extending in the Y direction and communicating with the ejectors. Each ejector includes a nozzle, a pressure chamber, a passage (connection channel) connecting the pressure chamber and the nozzle, a supply passage (first communication channel) that allows the pressure chamber to communicate with the common supply branch passage, and a discharge passage (second communication channel) that allows a passage to communicate with the common discharge branch passage.

In Japanese Patent Application Laid-open No. 2008-290292 (FIGS. 6 and 7), the passage (connection channel) connecting the pressure chamber and the nozzle extends perpendicularly to the discharge passage (second communication channel). In this case, a liquid flow orientation (vector orientation of the liquid flow) rapidly changes at a boundary between the connection channel and the second communication channel, causing a flow velocity difference. This easily results in stagnation and retention or accumulation of air bubbles.

An object of the present disclosure is to provide a liquid discharge head that can inhibit stagnation and retention or accumulation of air bubbles at a boundary between a connection channel and a second communication channel.

SUMMARY

According to an aspect of the present disclosure, there is provided a liquid discharge head, including a channel unit that includes an individual channel, a first common channel extending in a first direction and communicating with the individual channel, and a second common channel extending in the first direction and communicating with the individual channel, wherein the individual channel includes:

a nozzle;

a pressure chamber arranged apart from the nozzle in a second direction orthogonal to the first direction;

a connection channel having one end connected to the pressure chamber and the other end connected to the nozzle;

a first communication channel connecting the first common channel and the pressure chamber; and a second communication channel having one end connected to the connection channel and the other end connected to the second common channel;

wherein, a first vector is defined such that a starting point of the first vector is located on the connection channel and an ending point of the first vector is the other end of the connection channel, a second vector is defined such that a starting point of the second vector is the one end of the second communication channel and an ending point of the second vector is located on the second communication channel, and the second vector is orthogonal to the second direction, in a first plane orthogonal to the first direction, a first angle formed by a projection vector of the first vector onto the first plane and a projection vector of the second vector onto the first plane is less than 90°, and in a second plane orthogonal to the second direction, a second angle formed by a projection vector of the first vector onto the second plane and the second vector is less than 90°.

DESCRIPTION OF THE EMBODIMENTS

First Embodiment

Explanation is made about a schematic configuration of a printer 100 provided with heads 1 according to a first embodiment of the present disclosure.

An x direction, y direction, and z direction, which are orthogonal to each other, correspond respectively to a "first direction", "third direction", and "second direction" of the present disclosure. In this embodiment, the z direction is a vertical direction. A first side in the z direction (a front side of the sheet surface of FIG. 1) is an upper side, a second side in the z direction (a far side of the sheet surface of FIG. 1) is a lower side.

Figure 1:
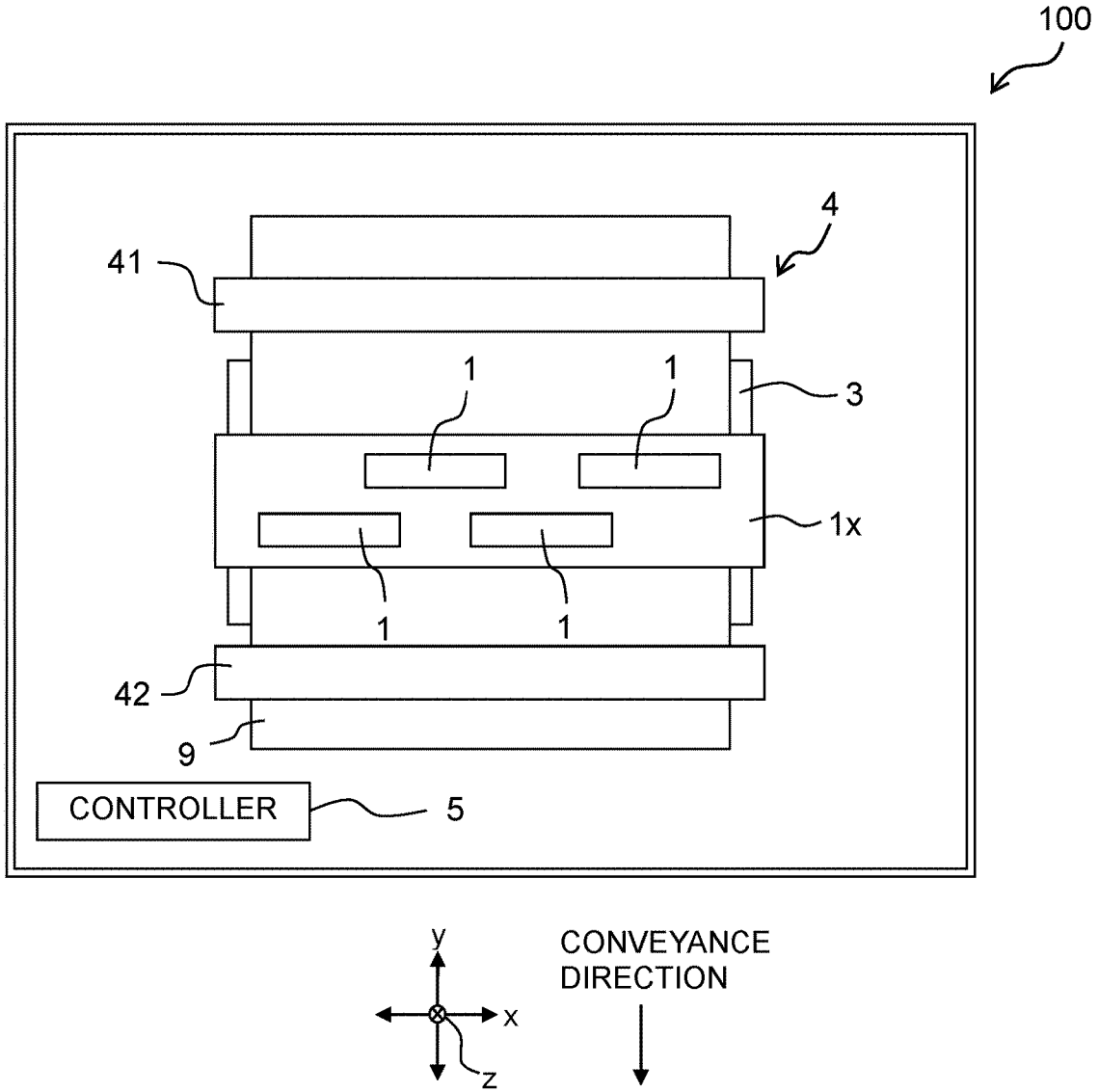
FIG. 1 is a plan view of a printer including a head according to a first embodiment of the present disclosure.

As depicted in FIG. 1, the printer 100 includes a head unit 1*x* including four heads 1, a platen 3, a conveyor 4, and a controller 5.

The head unit 1*x*, which is long in the x direction, is a line type in which ink is discharged on a sheet 9 with a position of the head unit 1*x* being fixed. The four heads 1 are long in the x direction and are arranged zigzag in the x direction.

The platen 3 is a plate-like member disposed at the second side in the z direction with respect to the head unit 1*x*. The sheet 9 is supported by a surface (i.e., upper surface) at the first side in the z direction of the platen 3.

The conveyor 4 includes two roller pairs 41 and 42 that interpose the head unit 1*x* and the platen 3 therebetween in the y direction, and a conveyance motor (not depicted) that rotates the roller pairs 41 and 42. When the conveyance motor is driven by control of the controller 5, the roller pairs 41 and 42 nipping the sheet 9 rotate to convey the sheet 9 in a conveyance direction. The conveyance direction is a direction along the y direction. The conveyance direction is a direction from a first side (the upper side in FIG. 1) in the y direction toward a second side (the lower side in FIG. 1) in the y direction.

The controller 5 includes a Central Processing Unit (CPU), a Read Only Memory (ROM), and a Random Access Memory (RAM). The ROM stores programs and data for allowing the CPU to execute a variety of control. The RAM temporarily stores data with which the CPU executes the program(s). When receiving a recording instruction (including image data) input from an external apparatus (personal computer or the like) or an input section (switch or button provided on an external surface of a casing of the printer 100), the CPU controls a driver IC and the conveyance motor (both not depicted) of each head 1 in accordance with the program(s) and data stored in the ROM and the RAM, and records an image on the sheet 9.

Subsequently, a configuration of the head 1 is explained specifically.

Figure 3:
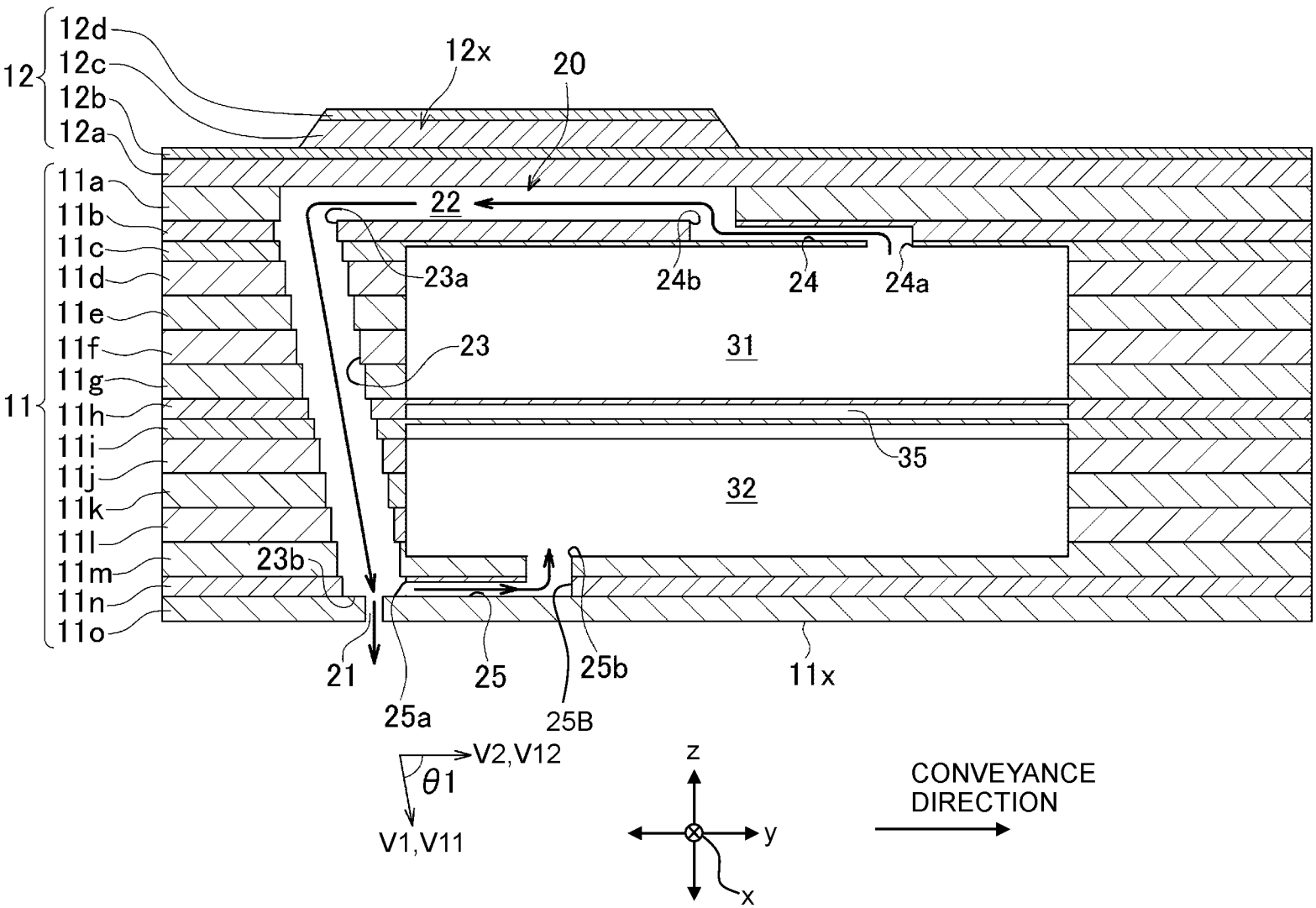
FIG. 3 is a cross-sectional view of the head taken along a line of FIG. 2.

As depicted in FIG. 3, the head 1 includes a channel unit 11 and an actuator unit 12.

The channel unit 11 is formed by 15 plates 11*a* to 11*o* adhered to each other. The plates 11*a* to 11*o* are stacked on top of each other in the z direction. Through holes and recesses forming channels are formed in the plates 11*a* to 11*o*. The channels include individual channels 20, a supply channel 31, and a return channel 32.

Figure 2:
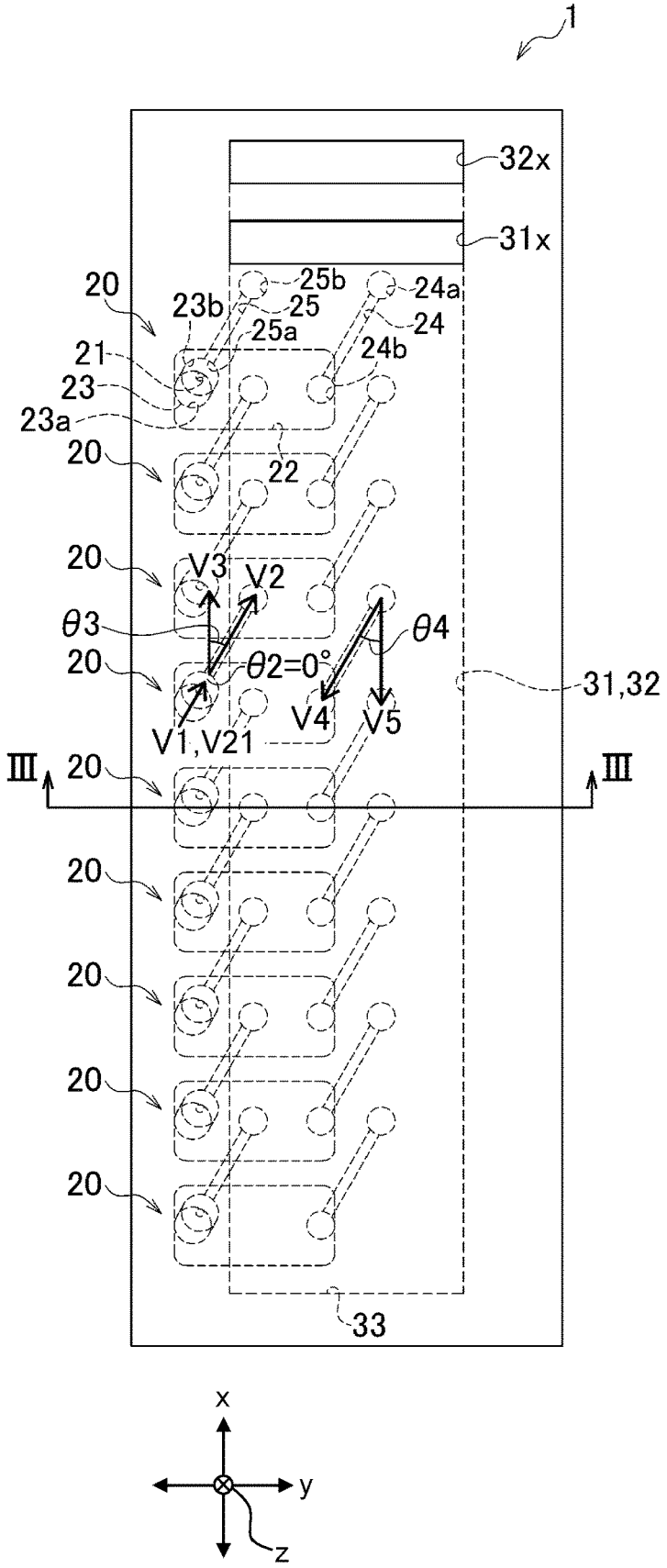
FIG. 2 is a plan view of the head.

As depicted in FIG. 2, the individual channels 20 are arranged in the x direction.

The supply channel 31 corresponds to a "first common channel" of the present disclosure, and the return channel 32 corresponds to a "second common channel" of the present disclosure. The supply channel 31 and the return channel 32 extend in the x direction and communicate with the individual channels 20.

In this embodiment, the supply channel 31 and the return channel 32 are arranged in the z direction as depicted in FIGS. 2 and 3. The length in the x direction, the length in the y direction, and the length in the z direction of the supply channel 31 are substantially the same as those of the return channel 32.

The supply channel 31 and the return channel 32 communicate with a subtank (not depicted) via an opening 31*x* and an opening 32*x*, respectively. The opening 31*x* is provided at one end (upper end in FIG. 2) in the x direction of the supply channel 31, and the opening 32*x* is provided at one end (upper end in FIG. 2) in the x direction the return channel 32. A coupling portion 33 provided at the other end (lower end in FIG. 2) in the x direction of the supply channel 31 and the other end (lower end in FIG. 2) in the x direction of the return channel 32 couples the supply channel 31 with the return channel 32.

The opening 31*x* corresponds to an "inlet of the first common channel" of the present disclosure. The opening 32*x* corresponds to an "outlet of the second common channel" of the present disclosure. The coupling portion 33 corresponds to an "outlet of the first common channel" and an "inlet of the second common channel" of the present disclosure. The coupling portion 33 is separated from the openings 31*x* and 32*x* in the x direction.

The subtank communicates with a main tank that stores ink. The subtank stores ink supplied from the main tank. Ink in the subtank flows into the supply channel 31 from the opening 31*x* by driving a pump (not depicted) through the control of the controller 5. Ink flowing into the supply channel 31 is supplied to each individual channel 20 while flowing through the supply channel 31 from the one end in the x direction (upper end in FIG. 2) to the other end in the x direction (lower end in FIG. 2). Ink reaching the other end in the x direction (lower end in FIG. 2) of the supply channel 31 (i.e., ink reaching the coupling portion 33) and ink flowing out of each individual channel 20 flow into the return channel 32. Ink flowing into the return channel 32 flows through the return channel 32 from the other end in the x direction (lower end in FIG. 2) toward the one end in the x direction (upper end in FIG. 2), and returns to the subtank via the opening 32*x*.

As depicted in FIG. 3, the supply channel 31 is configured by a recess formed in a lower surface of the plate 11*c* and through holes formed in the plates 11*d* to 11*g*. The return channel 32 is formed by a recess formed in a lower surface of the plate 11*i*, through holes formed in the plates 11*j* to 11*l*, and a recess formed in an upper surface of the plate 11*m*. A damper chamber 35 is provided between the supply channel 31 and the return channel 32 in the z direction. The damper chamber 35 is formed by a recess formed in a lower surface of the plate 11*h*.

As depicted in FIG. 3, each individual channel 20 includes a nozzle 21, a pressure chamber 22, a connection channel 23 connecting the nozzle 21 and the pressure chamber 22, an inflow channel 24 that allows the pressure chamber 22 to communicate with the supply channel 31, and an outflow channel 25 that allows the connection channel 23 to communicate with the return channel 32. A width (length in the x direction) of each of the inflow channel 24 and the outflow channel 25 is smaller than that of the pressure chamber 22. The inflow channel 24 and the outflow channel 25 function as throttles. The inflow channel 24 corresponds to a "first communication channel" of the present disclosure, and the outflow channel 25 corresponds to a "second communication channel" of the present disclosure.

The nozzle 21 is formed by a through hole formed in the plate 11*o*. The nozzle 21 is opened in a surface at the second side in the z direction (i.e., lower surface) of the channel unit 11. The lower surface 11*x* corresponds to a "nozzle surface" of the present disclosure. The lower surface 11*x* is a surface orthogonal to the z direction and along the x direction and the y direction. The nozzles 21 are formed in the lower surface 11*x*.

The pressure chamber 22 is formed by a through hole formed in the plate 11*a*. The pressure chamber 22 is opened in a surface at the first side in the z direction (i.e., upper surface) of the channel unit 11.

The connection channel 23 is a cylindrical channel extending downward from one end in the y direction of the pressure chamber 22. The connection channel 23 is formed by through holes formed in the plates 11*b* to 11*n*. The nozzle 21 is arranged immediately below the connection channel 23.

The connection channel 23 has one end 23*a* connected to the pressure chamber 22 and the other end 23*b* connected to the nozzle 21. The one end 23*a* is connected to a lower surface of the pressure chamber 22. The other end 23*b* is connected to an upper surface of the nozzle 21.

The inflow channel 24 has one end 24*a* connected to the supply channel 31 and the other end 24*b* connected to the pressure chamber 22. The one end 24*a* is connected to an upper surface of the supply channel 31. The other end 24*b* is connected to the lower surface of the pressure chamber 22.

The outflow channel 25 has one end 25*a* connected to the connection channel 23 and the other end 25*b* connected to the return channel 32. The one end 25*a* is connected to a side surface of the connection channel 23. The other end 25*b* is connected to a lower surface of the return channel 32.

In addition to the coupling portion 33 (see FIG. 2), the one end 24*a* of the inflow channel 24 corresponds to the "outlet of the first common channel" of the present disclosure. In addition to the coupling portion 33, the other end 25*b* of the outflow channel 25 corresponds to the "inlet of the second common channel" of the present disclosure. The one end 24*a* and the other end 25*b* are separated from the openings 31*x* and 32*x* (see FIG. 2) in the x direction.

As indicated by arrows in FIG. 3, ink flowing through the supply channel 31 is supplied to each individual channel 20 through the one end 24*a* of the inflow channel 24. Then, ink flows into the pressure chamber 22 through the other end 24*b* of the inflow channel 24, moves substantially horizontally through the pressure chamber 22, and flows into the connection channel 23. Ink flowing into the connection channel 23 flows downward therethrough. Part of the ink is discharged from the nozzle 21, and remaining ink flows through the outflow channel 25 and then flows out into the return channel 32 through the other end 25*b* of the outflow channel 25.

Circulating ink between the subtank and the channel unit 11 as described above discharges air bubbles and inhibits the increase in viscosity of ink in the individual channels 20, the supply channel 31, and the return channel 32 formed in the channel unit 11.

As depicted in FIG. 3, the connection channel 23 does not extend in a direction parallel to the z direction. The connection channel 23 extends in a direction inclined to the z direction (in a direction intersecting with the y direction and the z direction). A part of the outflow channel 25 extends parallel to the nozzle surface 11*x*, namely, the part of the outflow channel 25 is orthogonal to the z direction. Here, a first vector V1 and a second vector V2 are defined as follows.

First vector V1: a vector of which starting point is located on the connection channel 23 and of which ending point is the other end 23*b* of the connection channel 23.

Second vector V2: a vector of which starting point is the one end 25*a* of the outflow channel 25 and of which ending point is located on the outflow channel 25, and which is orthogonal to the z direction.

The starting point of the first vector V1 is a predefined position in the connection channel 23. In this embodiment, the predefined position in the connection channel 23 that is the starting point of the first vector V1 is the one end 23*a* of the connection channel 23. Further, the ending point of the second vector V2 is a predefined position in the outflow channel 25. The predefined position in the outflow channel 25 that is the ending point of the second vector V2 is, for example, a second end 25B in the y direction of the outflow channel 25. The outflow channel 25 has a first end (one end 25*a*) and the second end 25B in the y direction. The second end 25B is farther from the connection channel 23 than the first end (one end 25*a*).

The first vector V1 and the second vector V2 are projected on yz plane (a "first plane" of the present disclosure). As depicted in FIG. 3, in the yz plane, a first angle θ1 formed by a projection vector V11 of the first vector V1 onto the yz plane and a projection vector V12 of the second vector V2 onto the yz plane is less than 90°. As depicted in FIG. 3, in the yz plane, an orientation of the projection vector V11 is inclined to the z direction and the y direction, and an orientation of the projection vector V12 is parallel to the y direction.

In the connection channel 23, ink flows in the orientation of the first vector V1. In the part of the outflow channel 25, which is orthogonal to the z direction, ink flows in the orientation of the second vector V2. Further, the first angle θ1 is indicated by arrows V1 and V2 in FIG. 3. However, for the sake of clarity, the arrow V1 only indicates the orientation of the projection vector of the vector V1 in FIG. 3. That is, the arrow V1 in FIG. 3 does not indicate a magnitude of the projection vector of the first vector V1. Similarly, the arrow V2 in FIG. 3 only indicates the orientation of the projection vector of the second vector V2, and does not indicate a magnitude of the projection vector of the second vector V2. Similarly, in FIG. 2 and FIGS. 4 to 8, each of the arrow V1, the arrow V2, and arrows V3 to V5 relating to a third vector to a fifth vector described below only indicates an orientation of the corresponding vector or the corresponding projection vector. That is, each of them does not indicate a magnitude of the corresponding vector or the corresponding projection vector.

As depicted in FIG. 2, the connection channel 23 does not extends in a direction parallel to the y direction. The connection channel 23 extends in a direction inclined to the y direction (in a direction intersecting with the x direction and the y direction). Similar to the connection channel 23, the outflow channel 25 does not extend in the direction parallel to the y direction. The outflow channel 25 extends in a direction inclined to the y direction (in a direction intersecting with the x direction and the y direction).

The first vector V1 is projected on xy plane (a "second plane" of the present disclosure). The second vector V2 is parallel to the xy plane. As depicted in FIG. 2, in the xy plane, a second angle θ2 formed by a projection vector V21 of the first vector V1 onto the xy plane and the second vector V2 is less than 90°. In this embodiment, the projection vector V21 is parallel to the second vector V2 (i.e., the second angle θ2 formed by the projection vector V21 and the second vector V2 is 0°). As depicted in FIG. 2, an orientation of the projection vector V21 is inclined to the x direction and the y direction. An orientation of the second vector V2 is inclined to the x direction and the y direction.

Similar to the outflow channel 25, the inflow channel 24 does not extend in the direction parallel to the y direction. The inflow channel 24 extends in a direction inclined to the y direction (in a direction intersecting with the x direction and the y direction). The inflow channel 24 is parallel to the outflow channel 25.

The orientation of the second vector V2 contains a component of an ink flow orientation in the return channel 32. The ink flow orientation in the return channel 32 is an orientation along the x direction from a side of an inlet of the return channel 32 (the coupling portion 33 and the other end 25*b* of the outflow channel 25) toward a side of an outlet of the return channel 32 (the opening 32*x*). A third vector V3 is defined such that the third vector V3 is parallel to the x direction and contains a component directing from the inlet of the return channel 32 toward the outlet of the return channel 32. In the return channel 32, ink flows in an orientation of the third vector V3. The second vector V2 contains a component of the third vector V3. (The orientation of the second vector V2 contains a component of the orientation of the third vector V3). In other words, a third angle θ3 formed by the second vector V2 and the third vector V3 is less than 90°. In the xy plane, the third angle θ3 formed by the second vector V2 and the third vector V3 may be not less than 15° and not more than 45° (approximately 30° in this embodiment).

A fourth vector V4 is defined such that the fourth vector V4 is parallel to an extending direction of the inflow channel 24 orthogonal to the z direction, and contains a component directed from the one end of the inflow channel 24 toward the other end of the inflow channel 24. An orientation of the fourth vector V4 contains a component of an ink flow orientation in the supply channel 31. The ink flow orientation in the supply channel 31 is an orientation along the x direction from an inlet of the supply channel 31 (the opening 31*x*) toward an outlet of the supply channel 31 (the coupling portion 33 and the one end 24*a* of the inflow channel 24). A fifth vector V5 is defined such that the fifth vector V5 is parallel to the x direction and contains a component directing from the inlet of the supply channel 31 toward the outlet of the supply channel 31. In the inflow channel 24, ink flows in the orientation of the fourth vector V4. In the supply channel 31, ink flows in an orientation of the fifth vector V5. The fourth vector V4 contains a component of the fifth vector V5 (The orientation of the fourth vector V4 contains a component of the orientation of the fifth vector V5). In other words, a fourth angle θ4 formed by the fourth vector V4 and the fifth vector V5 is less than 90°. Further, in the xy plane, the fourth angle θ4 formed by the fourth vector V4 and the fifth vector V5 may be not less than 15° and not more than 45° (approximately 30° in this embodiment).

Although the line III-III in FIG. 2 is parallel to the y direction and does not pass through the inflow channel 24 and the outflow channel 25, FIG. 3 depicts a space of one individual channel 20 (including the inflow channel 24 and the outflow channel 25).

The actuator unit 12 includes a vibration plate 12*a*, a common electrode 12*b*, piezoelectric bodies 12*c*, and individual electrodes 12*d* in this order from below.

The vibration plate 12*a* and the common electrode 12*b* are arranged on an upper surface of the channel unit 11 (upper surface of the plate 11*a*) to cover all the pressure chambers 22 formed in the plate 11*a*. The piezoelectric bodies 12*c* and the individual electrodes 12*d* are provided corresponding to the respective pressure chambers 22 to overlap in the vertical direction with the respective pressure chambers 22.

The common electrode 12*b* and the individual electrodes 12*d* are electrically connected to a driver IC (not depicted). The driver IC maintains the electric potential of the common electrode 12*b* at the ground potential and changes the electric potential of the individual electrode(s) 12*d*. In particular, the driver IC generates a driving signal based on a control signal from the controller 5 and applies the driving signal to the individual electrode(s) 12*d*. This changes the electric potential of the individual electrode(s) 12*d* between a predefined driving potential and the ground potential. In this situation, the vibration plate 12*a* and a portion (actuator 12*x*) of the piezoelectric body 12*c* interposed between the individual electrode 12*d* and the pressure chamber 22 are deformed to be convex toward the pressure chamber 22, thus changing the volume of the pressure chamber 22. This applies pressure to ink in the pressure chamber 22 to discharge ink from the nozzle 21. The actuator unit 12 includes the actuators 12*x* corresponding to the respective pressure chambers 22.

As described above, in this embodiment, as depicted in FIG. 3, the first angle 01 formed by the projection vector V11 of the first vector V1 onto the yz plane and the projection vector V12 of the second vector V2 onto the yz plane is less than 90°, and as depicted in FIG. 2, the second angle θ2 formed by the projection vector V21 of the first vector V1 onto the xy plane and the second vector V2 is less than 90°. In this case, an ink flow orientation (vector orientation) changes more gently at a boundary between the connection channel 23 and the outflow channel 25 and a flow velocity difference at the boundary is less likely to occur than a case where the angles θ1 and θ2 are not less than 90°. It is thus possible to inhibit stagnation and retention or accumulation of air bubbles at the boundary between the connection channel 23 and the outflow channel 25.

The second angle θ2 may be not more than 30° (0° in this embodiment, see FIG. 2). In this case, the change in ink flow orientation (vector orientation) at the boundary between the connection channel 23 and the outflow channel 25 is more reliably gentler than a case where the second angle θ2 exceeds 30°. It is thus possible to more reliably inhibit a decrease in flow velocity at the boundary.

The orientation of the second vector V2 contains the component of the ink flow orientation in the return channel 32 (i.e., the orientation of the third vector V3, see FIG. 2). When the orientation of the second vector V2 does not contain the component of the orientation of the third vector V3 (e.g., a case where the orientation of the third vector V3 is directed from the upper side toward the lower side in FIG. 2), ink inflowing into the return channel 32 from the outflow channel 25 tends to flow in an orientation reverse to the ink flow orientation in the return channel 32. Thus, ink does not flow smoothly from the outflow channel 25 toward the return channel 32, further, toward the opening 32*x* as the outlet of the return channel 32. This may cause a problem in which air bubbles are not discharged smoothly. In this embodiment, since the orientation of the second vector V2 contains the component of the orientation of the third vector V3, ink flowing to the return channel 32 from the outflow channel 25 smoothly flows toward the opening 32*x* as the outlet of the return channel 32, thus facilitating the discharge of air bubbles.

In the xy plane, the third angle θ3 formed by the second vector V2 and the third vector V3 may be not less than 15° and not more than 45° (approximately 30° in this embodiment, see FIG. 2). It is assumed that the third angle θ3 is less than 15° in the xy plane under a condition that the length of the outflow channel 25 and the position of the other end 25*b* are not changed. In this case, the connection channel 23 may overlap with the return channel 32. It is thus not likely to adopt a configuration in which the third angle θ3 is less than 15°. When the third angle θ3 exceeds 45° in the xy plane, the component of orientation of the third vector V3 included in the orientation of the second vector V2 becomes small. This makes it difficult to obtain the above effect (ink flowing into the return channel 32 from the outflow channel 25 smoothly flows toward the opening 32*x* as the outlet of the return channel 32 to facilitate the discharge of air bubbles). In this embodiment, the third angle θ3 is not less than 15° and not more than 45° in the xy plane. This can avoid the state where the connection channel 23 overlaps with the return channel 32 and makes it possible to reliably obtain the above effect (ink flowing into the return channel 32 from the outflow channel 25 smoothly flows toward the opening 32*x* as the outlet of the return channel 32 to facilitate the discharge of air bubbles).

The orientation of the fourth vector V4 contains the component of the ink flow orientation in the supply channel 31 (i.e., the orientation of the fifth vector V5) (see FIG. 2). When the orientation of the fourth vector V4 does not contain the component of the orientation of the fifth vector V5 (e.g., a case where the fifth vector V5 is directed from the lower side toward the upper side in FIG. 2), ink inflowing into the inflow channel 24 from the supply channel 31 flows toward the pressure chamber 22 in a direction reverse to the ink flow orientation in the supply channel 31. The rapid change in the ink flow orientation may cause air bubbles. In this embodiment, the orientation of the fourth vector V4 contains the component of the orientation of the fifth vector V5, and thus ink flowing into the inflow channel 24 from the supply channel 31 smoothly flows toward the pressure chamber 22 to inhibit generation of air bubbles.

In the xy plane, the fourth angle θ4 formed by the fourth vector V4 and the fifth vector V5 is not less than 15° and not more than 45° (approximately 30° in this embodiment, see FIG. 2). When the fourth angle θ4 is less than 15° in the xy plane, the inflow channels 24 adjacent to each other in the x direction may overlap with each other. It is thus not likely to adopt a configuration in which the fourth angle θ4 is less than 15°. When the fourth angle θ4 exceeds 45° in the xy plane, the component of the orientation of the fifth vector V5 included in the orientation of the fourth vector V4 becomes small. This makes it difficult to obtain the above effect (ink flowing into the inflow channel 24 from the supply channel 31 smoothly flows toward the pressure chamber 22 to inhibit generation of air bubbles). In this embodiment, the fourth angle θ4 is not less than 15° and not more than 45° in the xy plane. This can avoid the state where the inflow channels 24 adjacent to each other in the x direction overlap with each other and makes it possible to reliably obtain the above effect (ink flowing into the inflow channel 24 from the supply channel 31 smoothly flows toward the pressure chamber 22 to inhibit generation of air bubbles).

The supply channel 31 and the return channel 32 are arranged in the z direction. The inflow channel 24 is parallel to the outflow channel 25 in the xy plane (see FIG. 2). In this case, the fourth vector V4 is parallel to the second vector V2 in the xy plane, and the third angle θ3 is the same as the fourth angle θ4. Thus, ink flowing into the inflow channel 24 from the supply channel 31, passing through the pressure chamber 22, and flowing toward the return channel 32 from the outflow channel 25 flows smoothly.

Second Embodiment

Figure 4:
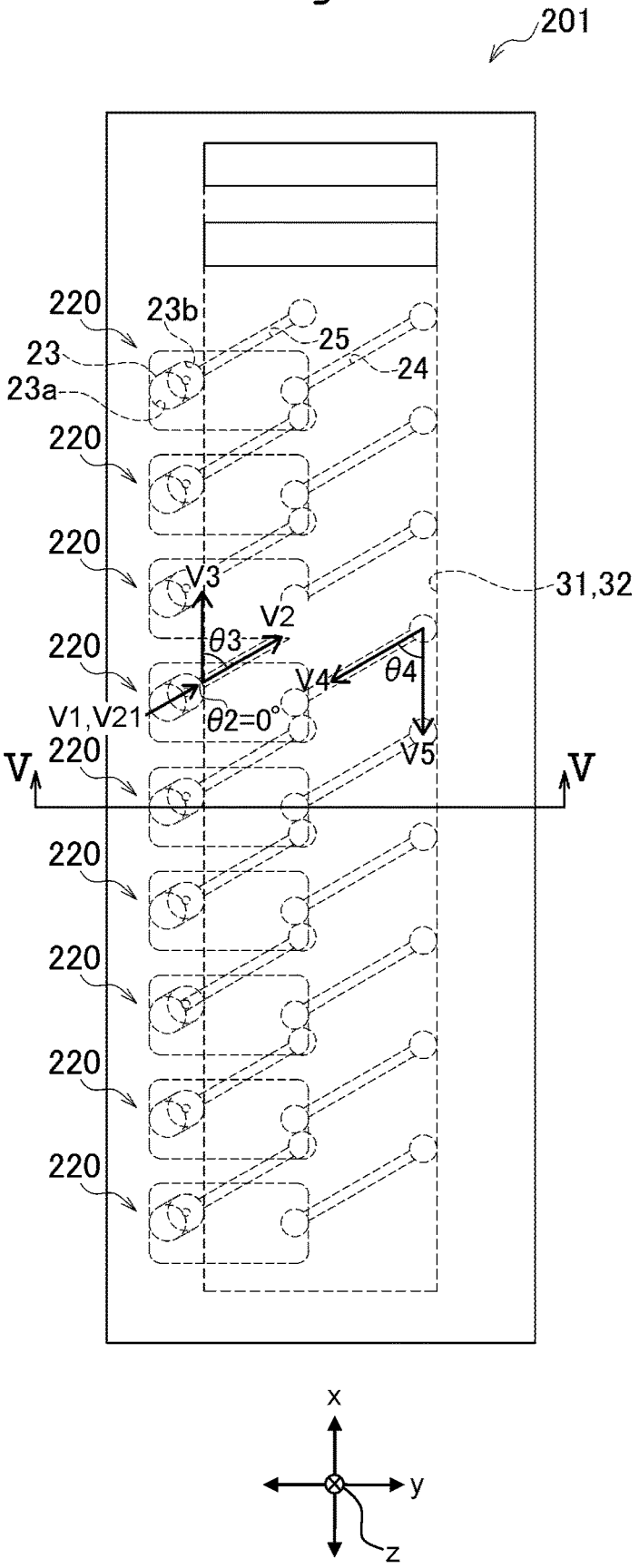
FIG. 4 is a plan view of a head according to a second embodiment of the present disclosure.
Figure 5:
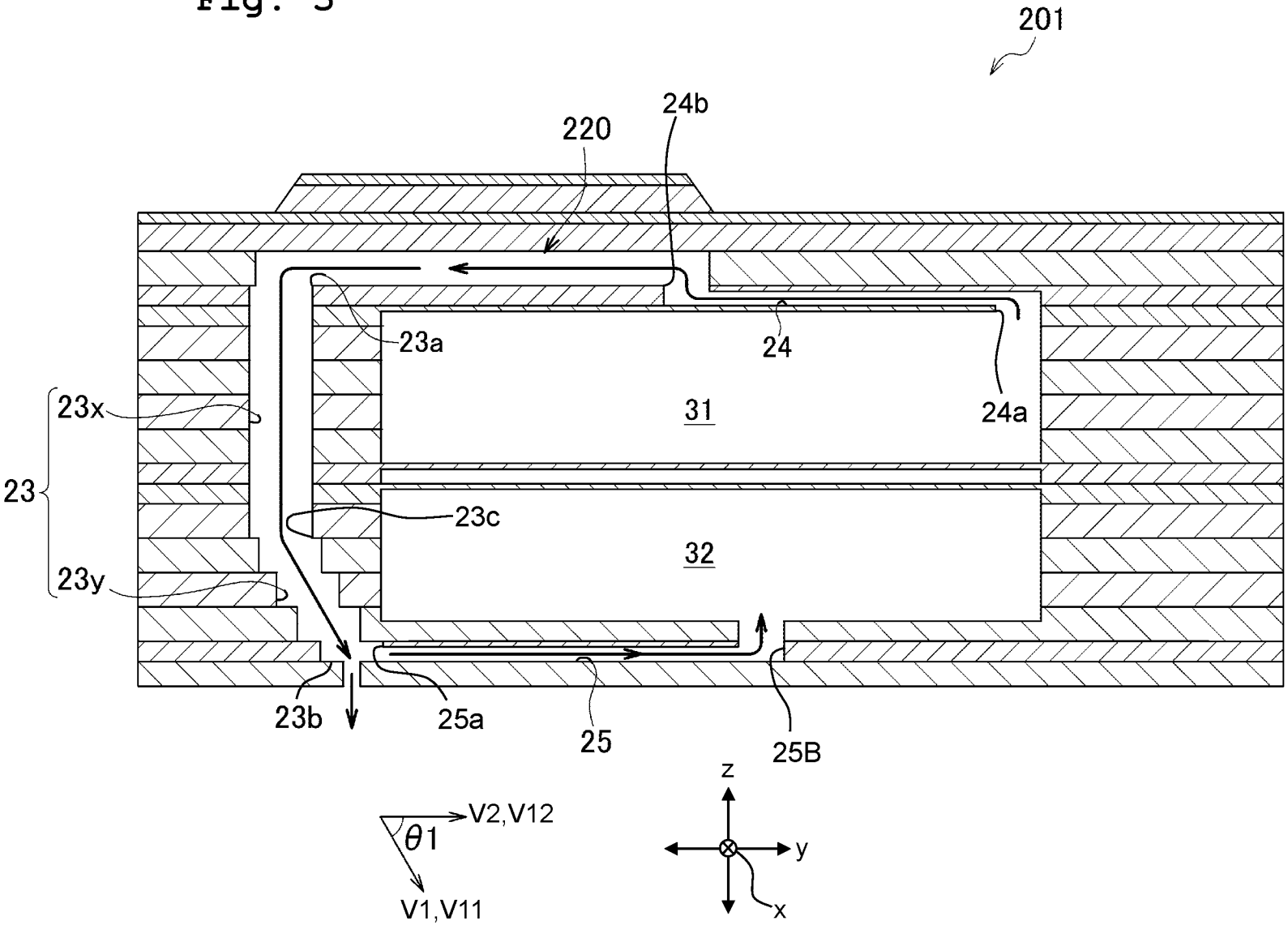
FIG. 5 is a cross-sectional view of the head taken along a line V-V of FIG. 4.

Referring to FIGS. 4 and 5, a head 201 according to a second embodiment of the present disclosure is explained.

In the first embodiment (FIG. 2), in the xy plane, the third angle θ3 formed by the second vector V2 and the third vector V3 and the fourth angle θ4 formed by the fourth vector V4 and the fifth vector V5 are approximately 30°. In the second embodiment (FIG. 4), in the xy plane, the third angle θ3 formed by the second vector V2 and the third vector V3 and the fourth angle θ4 formed by the fourth vector V4 and the fifth vector V5 are approximately 60°.

In the xy plane, the projection vector V21 of the first vector V1 onto the xy plane is parallel to the second vector V2 similar to the first embodiment (i.e., the second angle θ2 formed by the projection vector V21 and the vector V2 is 0°).

In the first embodiment (FIG. 3), an entirety of the connection channel 23 is inclined to the z direction. In the second embodiment (FIG. 5), only the vicinity of the other end 23*b* of the connection channel 23 is inclined to the z direction.

In the second embodiment (FIG. 5), the connection channel 23 includes an orthogonal portion 23*x* that has the one end 23*a* and that extends in the z direction, and an inclined portion 23*y* that is connected to the orthogonal portion 23*x*, that has the other end 23*b*, and that is inclined to the z direction.

The starting point of the first vector is the predefined position in the connection channel 23, and the ending point of the first vector is the other end 23*b* of the connection channel 23. In the first embodiment (FIG. 3), the predefined position in the connection channel 23 is the one end 23*a* of the connection channel 23. That is, the first vector V1 is the entirety of the connection channel 23 (from the one end 23*a* to the other end 23*b*). In the second embodiment (FIG. 5), the predefined position in the connection channel 23 is a boundary 23*c*. That is, the first vector V1 is the inclined portion 23*y* of the connection channel 23 (from the boundary 23*c* to the other end 23*b*). In other words, the inclined portion 23*y* extends in the orientation of the first vector V1.

The first angle θ1 formed by the projection vector V11 of the first vector V1 onto the yz plane and the projection vector V12 of the second vector V2 onto the yz plane according to the second embodiment is smaller than the first embodiment (FIG. 3). The first angle θ1 in the second embodiment is not less than 45° and not more than 75° (approximately 60° in the second embodiment).

Although the line V-V in FIG. 4 is parallel to the y direction and does not pass through the inflow channel 24 and the outflow channel 25, FIG. 5 depicts a space of one individual channel 220 (including the inflow channel 24 and the outflow channel 25).

As described above, in the second embodiment, the first angle θ1 is not less than 45° and not more than 75° (see FIG. 5). When the first angle θ1 is less than 45°, an ink flow orientation (vector orientation) rapidly changes at a starting point of the first vector V1 (the boundary 23*c* between the orthogonal portion 23*x* and the inclined portion 23*y* in the second embodiment, the boundary (one end 23*a*) between the connection channel 23 and the pressure chamber 22 in the first embodiment). When the first angle θ1 exceeds 75°, the effect of slowing the change in the ink flow orientation (vector orientation) at the boundary between the connection channel 23 and the outflow channel 25 may be decreased. In the second embodiment, since the first angle θ1 is not less than 45° and not more than 75°, the above problems can be inhibited.

Further, the connection channel 23 includes the orthogonal portion 23*x* and the inclined portion 23*y* (see FIG. 5). In this case (the second embodiment), it is possible to obtain following effect as compared with the case in which the entirety of the connection channel 23 is inclined to the z direction (see FIG. 3, the first embodiment). A larger space around the orthogonal portion 23*x* is secured in the second embodiment than that in the first embodiment because the orthogonal portion 23*x* is not inclined to the z direction in the second embodiment. As a result, the channels 31, 32 (in particular the supply channel 31) can be large.

Third Embodiment

Figure 6:
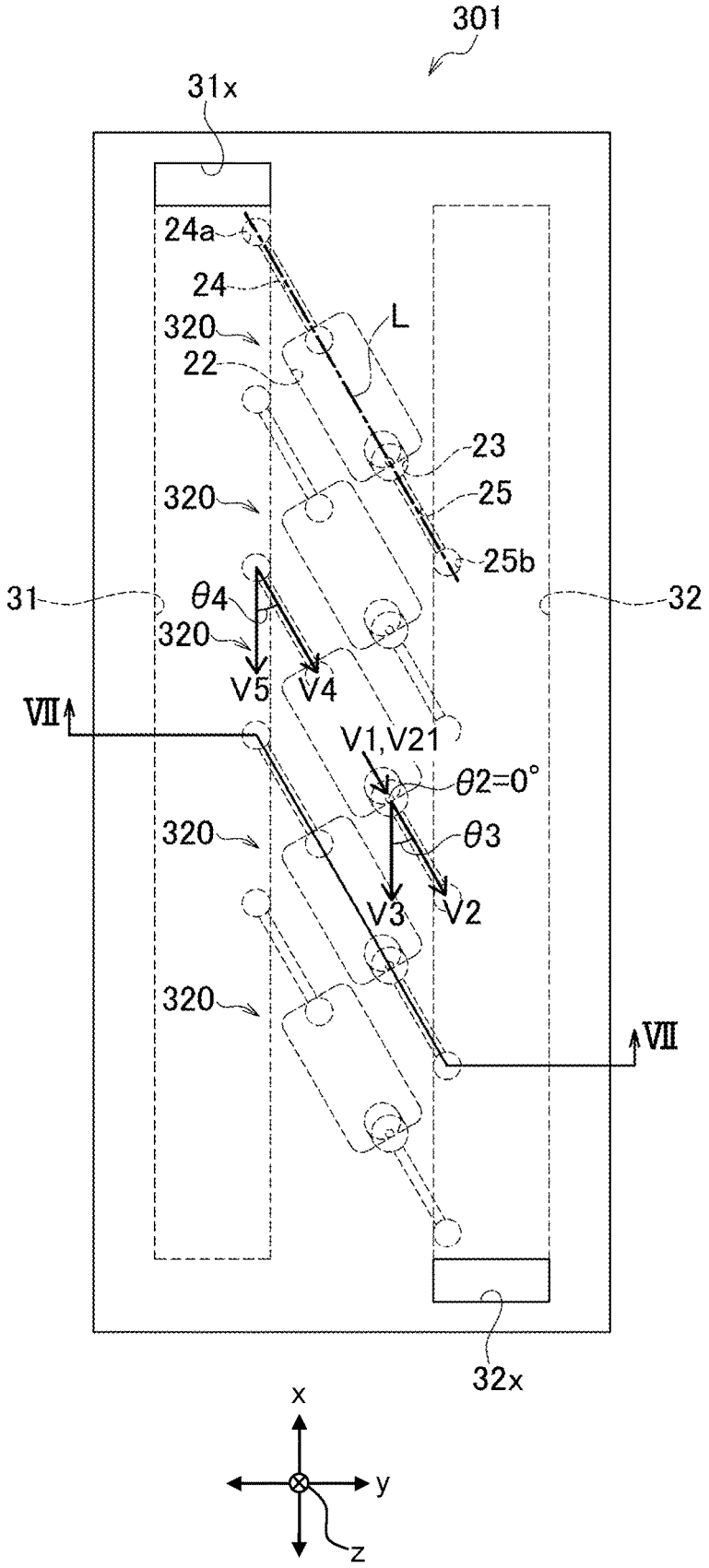
FIG. 6 is a plan view of a head according to a third embodiment of the present disclosure.
Figure 7:
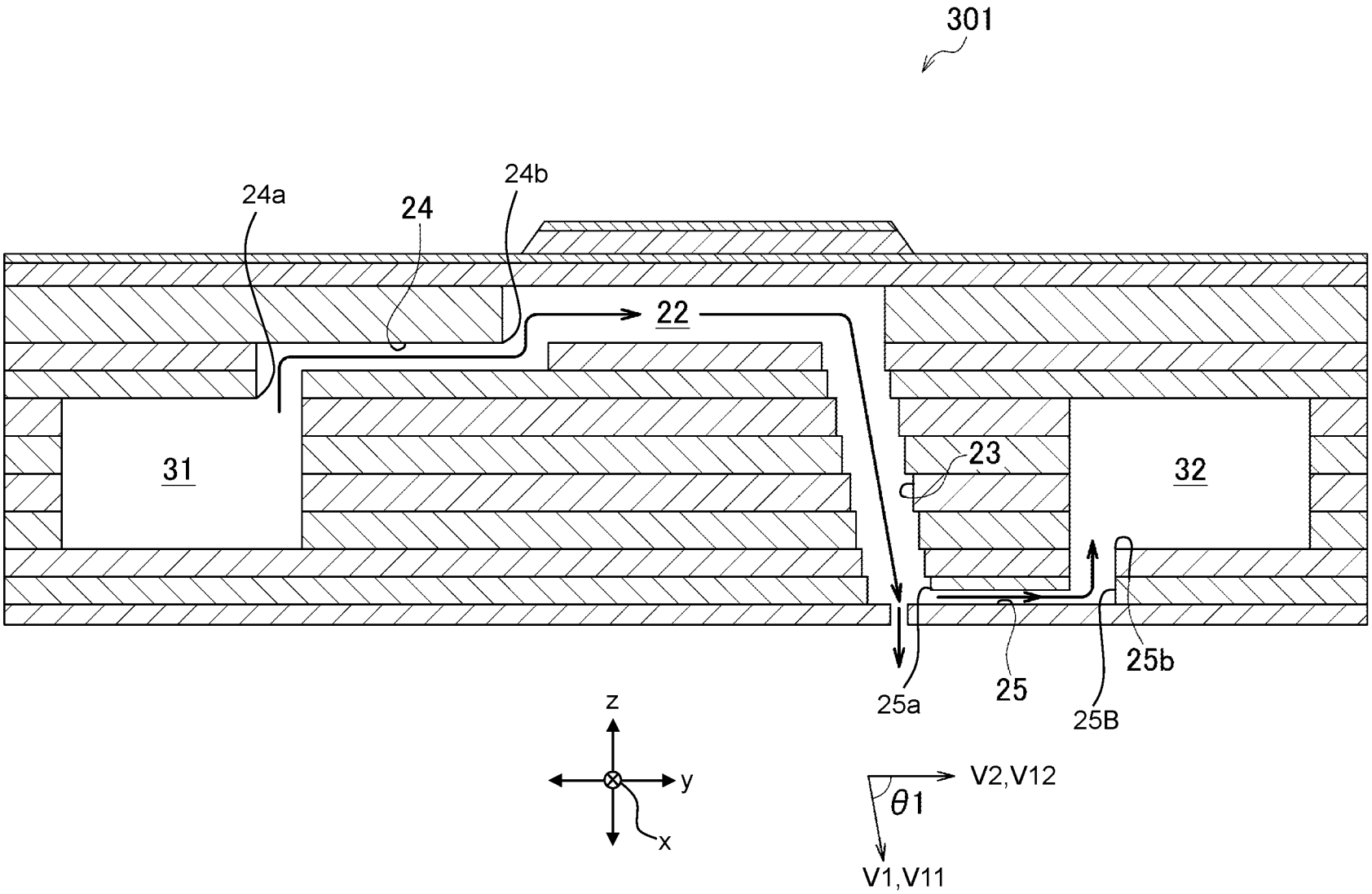
FIG. 7 is a cross-sectional view of the head taken along a line VII-VII of FIG. 6.

Referring to FIGS. 6 and 7, a head 301 according to a third embodiment of the present disclosure is explained.

In the first embodiment (FIGS. 2 and 3), the supply channel 31 and the return channel 32 are arranged in the z direction. In the third embodiment (FIGS. 6 and 7), the supply channel 31 and the return channel 32 are arranged in the y direction.

The supply channel 31 communicates with the subtank (not depicted) via the opening 31*x* provided at the one end in the x direction (upper end in FIG. 6). The return channel 32 communicates with the subtank (not depicted) via the opening 32*x* provided at the other end in the x direction (lower end in FIG. 6). The supply channel 31 communicates with the return channel 32 via individual channels 320 arranged in the x direction.

In the third embodiment, the opening 31*x* of the supply channel 31 corresponds to the "inlet of the first common channel" of the present disclosure, the one end 24*a* of the inflow channel 24 corresponds to the "outlet of the first common channel" of the present disclosure, the other end 25*b* of the outflow channel 25 corresponds to the "inlet of the second common channel" of the present disclosure, and the opening 32*x* corresponds to the "outlet of the second common channel" of the present disclosure. The opening 31*x* is separated from the one end 24*a* of each individual channel 320 in the x direction. The opening 32*x* is separated from the other end 25*b* of each individual channel 320 in the x direction.

The orientation of the third vector V3, which is directed, along the x direction, from the inlet of the return channel 32 (the other end 25*b* of the outflow channel 25) toward the outlet of the return channel 32 (the opening 32*x*) is an orientation directed from the upper side toward the lower side in FIG. 6 that is reverse to the first embodiment (FIG. 2).

As depicted in FIG. 6, the third embodiment is the same as the first embodiment in that the third angle θ3 formed by the second vector V2 and the third vector V3 in the xy plane is approximately 30°, that the fourth angle θ4 formed by the fourth vector V4 and the fifth vector V5 in the xy plane is approximately 30°, that the projection vector V21 of the first vector V1 onto the xy plane is parallel to the second vector V2 (i.e., the second angle θ2 formed by the projection vector V21 and the vector V2 is 0°), and that the first angle θ1 formed by the projection vector V11 of the first vector V1 onto the yz plane and the projection vector V12 of the second vector V2 onto the yz plane is less than 90° as depicted in FIG. 7.

In this embodiment, as depicted in FIG. 6, when seen from the z direction, in the xy plane, the pressure chamber 22, the connection channel 23, the inflow channel 24, and the outflow channel 25 extend in a direction inclined to the y direction (direction intersecting with the x direction and the y direction). When seen from the z direction, in the xy plane, the pressure chamber 22, the connection channel 23, the inflow channel 24, and the outflow channel 25 extend parallelly to each other. When seen from the z direction, in the xy plane, the pressure chamber 22, the connection channel 23, the inflow channel 24, and the outflow channel 25 are arranged on a virtual straight line L along the direction intersecting with the x direction and the y direction.

As described above, in this embodiment, the supply channel 31 and the return channel 32 are arranged in the y direction. When seen from the z direction, in the xy plane, the inflow channel 24 and the outflow channel 25 are arranged on the virtual straight line L intersecting with the x direction and the y direction. In this case, ink flowing from the supply channel 31 into the inflow channel 24, passing through the pressure chamber 22, and flowing from the outflow channel 25 toward the return channel 32 flows smoothly.

Fourth Embodiment

Figure 8:
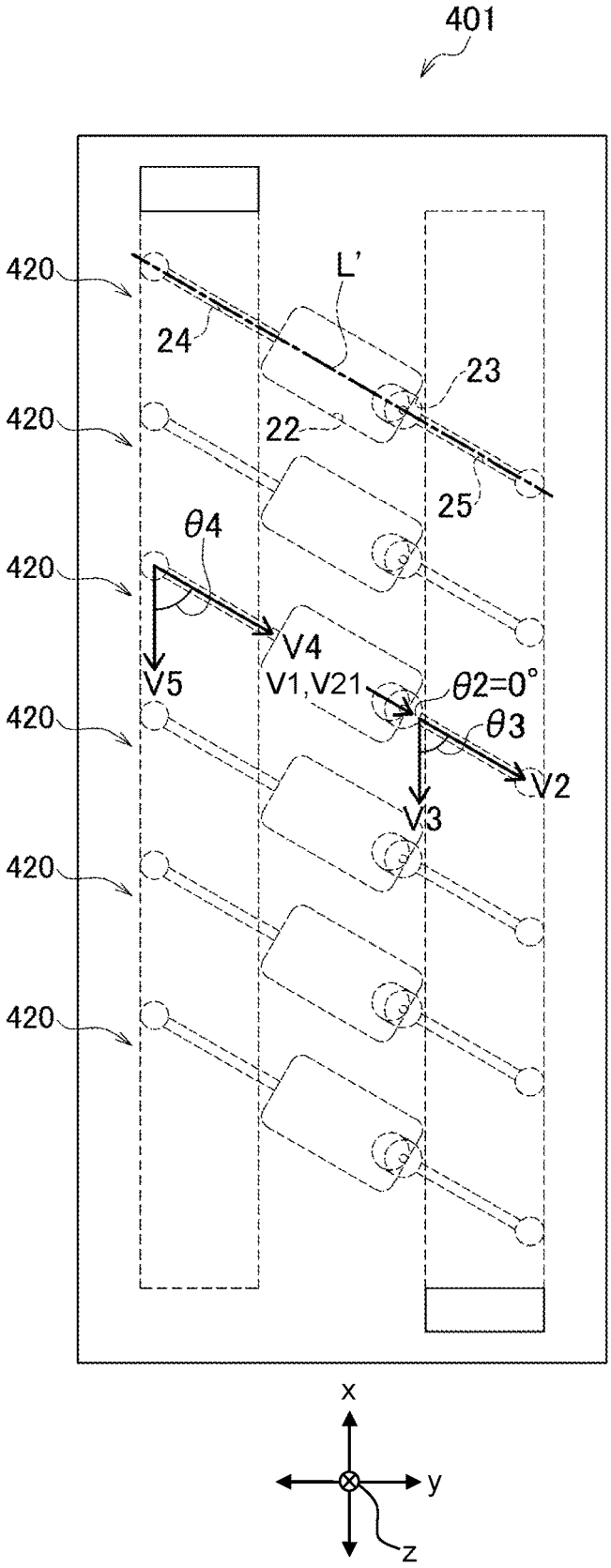
FIG. 8 is a plan view of a head according to a fourth embodiment of the present disclosure.

Referring to FIG. 8, a head 401 according to a fourth embodiment of the present disclosure is explained.

The fourth embodiment (FIG. 8) is a modified example of the third embodiment (FIG. 6). In the xy plane, the third angle θ3 formed by the second vector V2 and the third vector V3 and the fourth angle θ4 formed by the fourth vector V4 and the fifth vector V5 are larger than the third embodiment. The angles θ3 and θ4 are approximately 60° in the fourth embodiment.

The fourth embodiment is the same as the third embodiment, for example, in that, in the xy plane, the projection vector V21 of the first vector V1 onto the xy plane is parallel to the second vector V2 (i.e., the second angle θ2 formed by the projection vector V21 and the vector V2 is 0°).

Similar to the third embodiment, in each individual channel 420, when seen from the z direction, in the xy plane, the pressure chamber 22, the connection channel 23, the inflow channel 24, and the outflow channel 25 extend in a direction inclined to the y direction (direction intersecting with the x direction and the y direction). When seen from the z direction, in the xy plane, the pressure chamber 22, the connection channel 23, the inflow channel 24, and the outflow channel 25 extend parallelly to each other. When seen from the z direction, in the xy plane, the pressure chamber 22, the connection channel 23, the inflow channel 24, and the outflow channel 25 are arranged on a virtual straight line L' along the direction intersecting with the x direction and the y direction.

As described above, the angles θ3 and θ4 in the fourth embodiment are different from the third embodiment. However, since any other configurations than the above are similar to the third embodiment, it is possible to obtain the effect similar to the third embodiment.

Modified Examples

The preferred embodiments of the present disclosure are described above. However, the present disclosure is not limited to the above embodiments. Various changes or modifications in the design may be made without departing from the claims.

In the above embodiments (FIGS. 2, 4, 6, and 8), the second angle θ2 is 0°. However, it is only required that the second angle θ2 is less than 90° (preferably not more than 30°). That is, the first vector V1 projected on the xy plane may intersect with the second vector V2 projected on the xy plane. In this case, for example, the connection channel 23 may be disposed so that the projected first vector V1 in FIG. 2 rotates clockwise or counterclockwise.

In the above embodiments (FIGS. 2, 4, 6, and 8), the third angle θ3 and the fourth angle θ4 are identical to each other. However, the third angle θ3 and the fourth angle θ4 may be different from each other.

In the first embodiment (FIG. 2) and the second embodiment (FIG. 4), the inflow channel 24 is parallel to the outflow channel 25. The present disclosure, however, is not limited thereto. For example, the third angle θ3 may be different from the fourth angle θ4 and the inflow channel 24 may not be parallel to the outflow channel 25.

In the third embodiment (FIG. 6) and the fourth embodiment (FIG. 8), the inflow channel 24 and the outflow channel 25 are arranged on the virtual straight lines L and L'. The present disclosure, however, is not limited thereto. For example, the third angle θ3 may be different from the fourth angle θ4 and the inflow channel 24 and the outflow channel 25 may not be arranged on the virtual straight lines L and L'.

The liquid discharge head is not limited to the line type head. The liquid discharge head may be a serial type head in which liquid is discharged from nozzles on a medium (an object to which liquid is to be discharged) during its movement in a scanning direction parallel to the nozzle surface.

The medium is not limited to the sheet or paper, and may be a cloth, a substrate, and the like.

The liquid discharged from the nozzles is not limited to the ink, and may be any liquid (e.g., a treatment liquid that agglutinates or precipitates constituents of ink).

The present disclosure is applicable to facsimiles, copy machines, multifunction peripherals, and the like without limited to printers. The present disclosure is also applicable to a liquid discharge apparatus used for any other application than the image recording (e.g., a liquid discharge apparatus that forms an electroconductive pattern by discharging an electroconductive liquid on a substrate).

What is claimed is:

1. A liquid discharge head, comprising a channel unit that includes an individual channel, a first common channel extending in a first direction and communicating with the individual channel, and a second common channel extending in the first direction and communicating with the individual channel, wherein the individual channel includes:

a nozzle;

a pressure chamber arranged apart from the nozzle in a second direction orthogonal to the first direction;

a connection channel having one end connected to the pressure chamber and the other end connected to the nozzle;

a first communication channel connecting the first common channel and the pressure chamber; and a second communication channel having one end connected to the connection channel and the other end connected to the second common channel;

wherein, a first vector is defined such that a starting point of the first vector is located on the connection channel and an ending point of the first vector is the other end of the connection channel, a second vector is defined such that a starting point of the second vector is the one end of the second communication channel and an ending point of the second vector is located on the second communication channel, and the second vector is orthogonal to the second direction, in a first plane orthogonal to the first direction, a first angle formed by a projection vector of the first vector onto the first plane and a projection vector of the second vector onto the first plane is less than 90°, and in a second plane orthogonal to the second direction, a second angle formed by a projection vector of the first vector onto the second plane and the second vector is less than 90°.

2. The liquid discharge head according to claim 1, wherein the first angle is 45° to 75°.

3. The liquid discharge head according to claim 1, wherein the second angle is not more than 30°.

4. The liquid discharge head according to claim 1, wherein the second angle is 0°.

5. The liquid discharge head according to claim 1, wherein a third direction is orthogonal to the first direction and the second direction, and an orientation of the projection vector of the first vector onto the first plane is inclined to the second direction and the third direction.

6. The liquid discharge head according to claim 1, wherein a third direction is orthogonal to the first direction and the second direction, and an orientation of the projection vector of the first vector onto the second plane is inclined to the first direction and the third direction.

7. The liquid discharge head according to claim 1, wherein the starting point of the first vector is the one end of the connection channel and the ending point of the first vector is the other end of the connection channel.

8. The liquid discharge head according to claim 1, wherein the connection channel includes an orthogonal portion having the one end and extending in the second direction, and an inclined portion connected to the orthogonal portion and having the other end, the starting point of the first vector is a boundary between the orthogonal portion and the inclined portion of the connection channel and the ending point of the first vector is the other end of the connection channel.

9. The liquid discharge head according to claim 1, wherein the second common channel has an inlet and an outlet apart from the inlet in the first direction, a third vector is parallel to the first direction, and contains a component directing from the inlet of the second common channel toward the outlet of the second common channel, and the second vector contains a component of the third vector.

10. The liquid discharge head according to claim 9, wherein in the second plane, a third angle formed by the second vector and the third vector is 15° to 45°.

11. The liquid discharge head according to claim 1, wherein the first communication channel has one end connected to the first common channel and the other end connected to the pressure chamber, a fourth vector is parallel to an extending direction of the first communication channel orthogonal to the second direction, and contains a component directing from the one end of the first communication channel toward the other end of the first communication channel, the first common channel has an inlet and an outlet apart from the inlet in the first direction, a fifth vector is parallel to the first direction, and contains a component directing from the inlet of the first common channel toward the outlet of the first common channel, and the fourth vector contains a component of the fifth vector.

12. The liquid discharge head according to claim 11, wherein in the second plane, a fourth angle formed by the fourth vector and the fifth vector is 15° to 45°.

13. The liquid discharge head according to claim 1, wherein the first common channel and the second common channel are arranged in the second direction, and the first communication channel is parallel to the second communication channel.

14. The liquid discharge head according to claim 1, wherein the first common channel and the second common channel are arranged in a third direction orthogonal to the first direction and the second direction, and the first communication channel and the second communication channel are arranged on a virtual line intersecting with the first direction and the third direction when seen from the second direction.

* * * * *